United States Patent [19]

Kimura

[11] Patent Number: 4,826,335

[45] **Date of Patent: * May 2, 1989**

[54] RECORDING APPARATUS HAVING A ROTATABLE COVER INCLUDING A GUIDE FOR GUIDING A NON-CONTINUOUS RECORD SHEET TO A RECORDING HEAD AND HAVING ANOTHER GUIDE FOR GUIDING A CONTINUOUS RECORD SHEET HAVING HOLES THEREIN TO THE RECORDING HEAD

[75] Inventor: Tetsuo Kimura, Sagamihara, Japan

[73] Assignee: Canon Kabushiki Kaisha, Tokyo, Japan

[ * ] Notice: The portion of the term of this patent subsequent to Jun. 23, 2004 has been disclaimed.

[21] Appl. No.: 2,232

[22] Filed: Jan. 12, 1987

Related U.S. Application Data

[63] Continuation of Ser. No. 834,137, Feb. 24, 1987, Pat. No. 4,674,899, which is a continuation of Ser. No. 556,136, Nov. 29, 1983, abandoned.

[30] Foreign Application Priority Data

Dec. 7, 1982 [JP] Japan ..... 57-214406

[51] Int. Cl.[4] ..... B41J 11/00; B41J 11/28

[52] U.S. Cl. ..... 400/605; 400/613.2; 400/616.3; 400/568

[58] Field of Search ..... 400/605, 613, 613.1, 400/613.2, 613.3, 613.4, 616, 616.1, 616.2, 616.3, 618, 639.1, 689, 690, 690.1, 690.4, 708, 708.1, 568

[56] References Cited

U.S. PATENT DOCUMENTS

| | | | |
|---|---|---|---|
| 2,131,152 | 9/1938 | Stickney | 400/616.3 |
| 3,070,204 | 12/1962 | Bradshaw | 400/613.2 X |
| 3,135,372 | 6/1964 | Baughman | 400/690 |
| 3,513,938 | 5/1970 | Buehner et al. | 400/690.1 X |
| 3,653,483 | 4/1972 | Cortona et al. | 400/613 X |
| 3,753,483 | 8/1973 | Lundquist et al. | 400/616.1 X |
| 3,880,016 | 4/1975 | Jamieson et al. | 400/567 X |
| 3,912,069 | 10/1975 | Faulhaber | 400/690.4 |
| 3,966,037 | 6/1976 | Zambolin | 400/618 X |
| 4,164,376 | 8/1979 | Yarp | 400/616.1 X |
| 4,227,821 | 10/1980 | Plaza et al. | 400/616.3 |
| 4,354,766 | 10/1982 | Hendrischk et al. | 400/616.1 X |
| 4,368,994 | 1/1983 | Sweeney | 400/568 X |
| 4,372,694 | 2/1983 | Bovio et al. | 400/613.1 X |
| 4,452,543 | 6/1984 | Adkisson et al. | 400/639.1 X |
| 4,674,899 | 6/1987 | Kimura | 400/613 X |

FOREIGN PATENT DOCUMENTS

| | | | |
|---|---|---|---|
| 3107134 | 9/1982 | Fed. Rep. of Germany | 400/613 |
| 557904 | 8/1923 | France | 400/613.2 |
| 0044808 | 3/1980 | Japan . | |
| 0090388 | 7/1980 | Japan | 400/613 |
| 57-38175(A) | 3/1982 | Japan . | |
| 0084883 | 5/1982 | Japan | 400/613 |
| 0087385 | 5/1982 | Japan | 400/613 |

OTHER PUBLICATIONS

Xerox Disclosure Journal, "Paper-Out Sensing Apparatus", Jagger, vol. 1, No. 5, May 1976, pp. 67–68.

*Primary Examiner*—Ernest T. Wright, Jr.
*Attorney, Agent, or Firm*—Fitzpatrick, Cella, Harper & Scinto

[57] ABSTRACT

A recording apparatus including a body having a case, a first feeding device, a guide portion, a second feeding device, and a cover. The first feeding device feeds a record sheet to a recording position by frictional force. The guide portion guides a continuous record sheet supplied from a record paper source disposed outside of the apparatus. The second feeding device accepts the record sheet from the guide portion and feeds the record sheet to the recording position through the first feeding device. The second feeding device includes at least one pin which is adapted to engage a hole in the record sheet. The cover has a free end including a guide for guiding a non-continuous record sheet from outside the apparatus to the recording position through the first feeding device. The cover further has an engagement portion on the opposite end of the cover from the guide, for rotatably attaching the cover to the case.

7 Claims, 4 Drawing Sheets

RECORDING APPARATUS HAVING A ROTATABLE COVER INCLUDING A GUIDE FOR GUIDING A NON-CONTINUOUS RECORD SHEET TO A RECORDING HEAD AND HAVING ANOTHER GUIDE FOR GUIDING A CONTINUOUS RECORD SHEET HAVING HOLES THEREIN TO THE RECORDING HEAD

This is a continuation of application Ser. No. 834,137, filed Feb. 24, 1986, U.S. Pat. No. 4,674,899, issued June 22, 1987 which is a continuation of Ser. No. 556,136, filed Nov. 29, 1983 now abandoned.

BACKGROUND OF THE INVENTION

1. Field of the Invention

The present invention relates to a recorder which allows easy loading of a record form.

2. Description of the Prior Art

In a printer, a paper roll of an elongated record form or a fan-folded stack of an elongated fan-folded record form having feed sprocket holes on both sides and being stacked in an accordion shape is usually used.

FIGS. 1–4 show a prior art printer 1. In the prior art printer 1, when the fan-folded form stack 2 with feed holes 2*a* is used (see FIGS. 1 and 2), a form guide 3 to guide the fan-folded form is to be mounted. When the paper roll 4 is used, a roll holder 5 is to be mounted. The operation is therefore troublesome and such a prior art printer has many other disadvantages.

SUMMARY OF THE INVENTION

It is an object of the present invention to provide a recorder which it is easy to load a record form and easy to remove a jammed record form.

It is another object of the present invention to provide a recorder which allows easy loading of an elongated record form as well as non-continuous record sheets.

It is another object of the present invention to provide a recorder which is simple in construction and allows easy loading of a first elongated record form source into the recorder and easy loading of an elongated record form taken out of a second external record form source into the recorder.

It is another object of the present invention to provide a recorder which can record on first and second elongated record forms and on non-continuous record sheets, in which ends of the respective elongated record forms are detected by one detector and the end of the record sheet is not detected so that the record can be up to a printed lowermost line of the record sheet.

It is a further object of the present invention to provide a recorder having means for preventing the fan-folded forms from separating from a tractor when the fan-folded form is used and applying a back tension to the record paper when the record paper roll is used.

DETAILED DESCRIPTION OF THE PREFERRED EMBODIMENT

Figure 1:
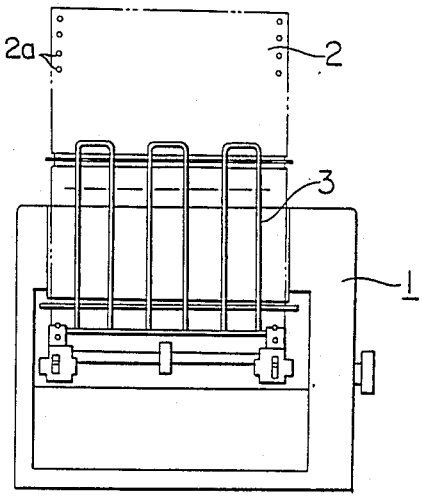
FIG. 1 PRIOR ART
FIGS. 1 and 2 illustrate use of a fan-folded form in a prior art printer.
Figure 2:
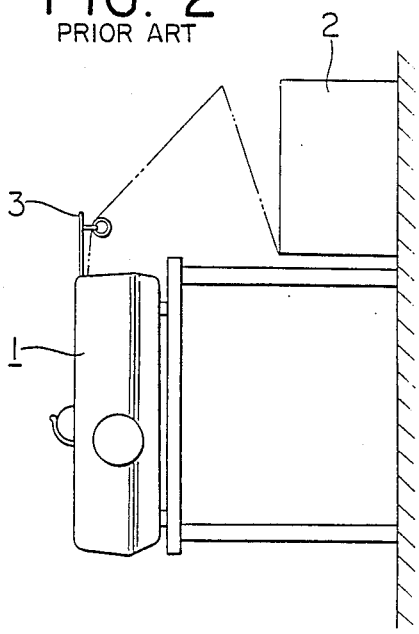
FIG. 2 PRIOR ART
Figure 3:
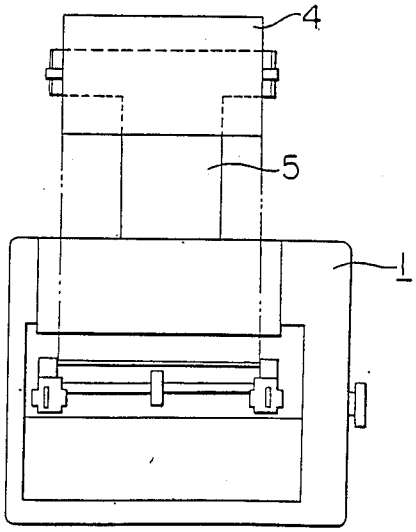
FIG. 3 PRIOR ART
FIGS. 3 and 4 illustrate use of a record paper roll in the prior art printer.
Figure 4:
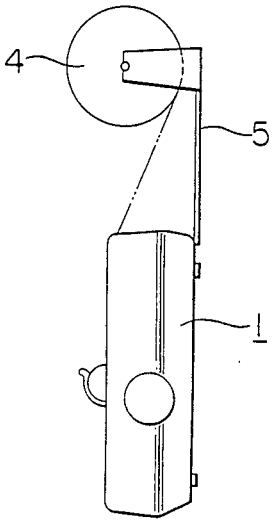
FIG. 4 PRIOR ART
Figure 5:
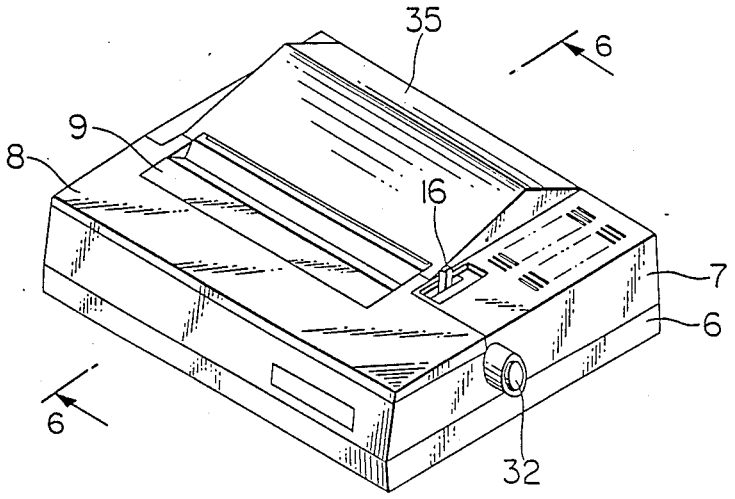
FIG. 5 shows an external view of one embodiment of the present invention.
Figure 6:
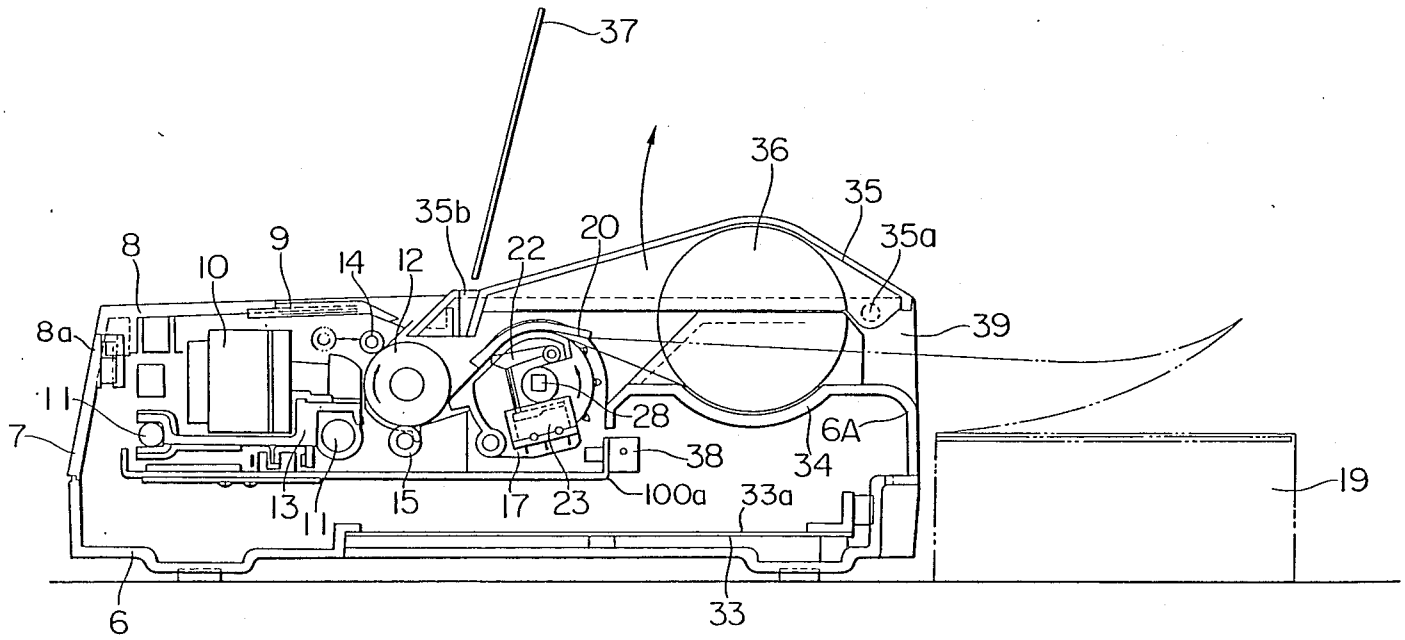
FIG. 6 is a sectional view taken along a line 6—6 in FIG. 5.

FIG. 5 shows an embodiment of a printer or recorder 100 of the present invention. Numeral 6 denotes a lower case and numeral 7 denotes an upper case bolted to the lower case 6. The upper case 7 and the lower case 6 form a case 67 for the recorder 100, in which elements such as record means (described below) are accommodated to form the recorder 100 as a whole. Numeral 8 denotes a front cover rotatably pivoted, such as at mount 8*a* to the upper case 7 and numeral 9 denotes a transparent plate bonded to the front cover 8 to allow observation of the inside of the recorder 100. As shown in FIG. 6, the front cover 8 covers a record means which in the present embodiment comprises a print head 10 which is a wire print head. The print or record head 10 is mounted on a carriage 13 which is guided by guide rails 11 and moves along a platen roll 12. The platen roll 12 is arranged in front of the print head 10. Record paper is wrapped around the platen roll 12 (as described below), which is rotated in a direction of the arrow to successively feed the record paper to a recording location at the front of the print head 10. In this manner, the record head 10 and the platen roll 12 cooperate to form the record means to record on the record paper. Numeral 14 denotes a paper pressing roller and numeral 15 denotes a pinch roller. Roller 14 is selectively pressed to the platen roll 12 by an actuation lever 16 (FIG. 5). FIG. 6 shows two different positions roller 14 assumes in response to actuation by lever 16. The position in which roller 14 presses on roller 12 is shown in solid lines and the inactive position is shown in chained lines with a two way arrow indicating movement between these two positions. Numerals 17 and 18 denote tractors for feeding record paper in the form of a fan-folded form having holes on both sides (such as that depicted in FIG. 1), taken out of a fan-folded form stack 19. The fan-folded paper is fed toward the platen roll 12 by pins 17*a* and 18*a*. The fan-folded stack 19 is loaded externally of the recorder 100 as shown in FIG. 6 and serves as one of the record paper sources for the recorder 100. The tractors 17 and 18 are movable in the width direction of the form depending on the width of the form to be fed. Numerals 20 and 21 denote tractor covers attached to the tractors 17 and 18. When the fan-folded form is mounted on the tractors 17 and 18, the covers 20 and 21 are opened and the pins 17*a* and 18*a* are fitted to the holes of the form, and then the covers 20, 21 are closed. Thus, the tractor covers 20 and 21 prevent the fan-folded form from separating from the tractors 17, 18 and assures stable feeding of the form by the pins 17*a* and 18*a*. When the record paper roll 36, which is another record paper source, is loaded on a roll holder 34 and the record paper is fed from the roll 36, the tractor covers 20 and 21 hold the record paper with the tractors 17 and 18 to apply a frictional force to the record paper. As a result, a back tension is applied to the record paper when the platen roll 12 is rotated in the direction of the arrow to feed the record paper.

Figure 8:
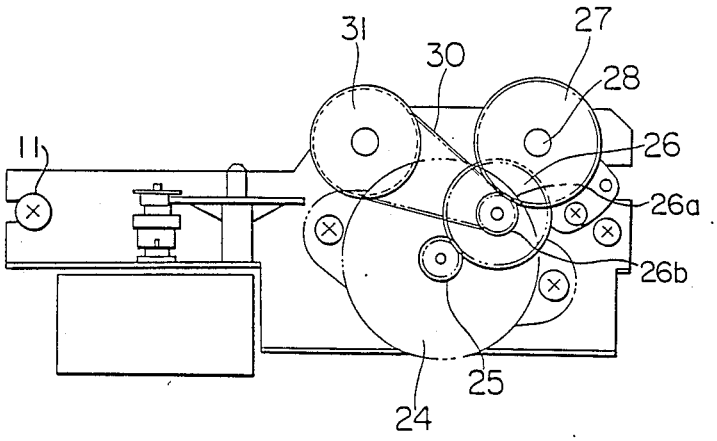
FIG. 8 is a right elevational view of FIG. 7.
Figure 7:
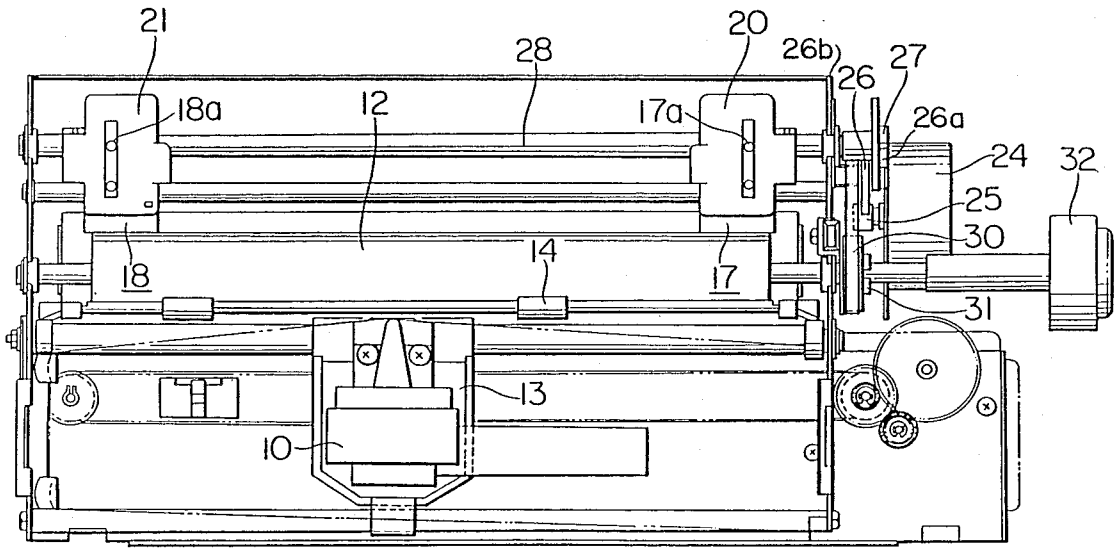
FIG. 7 is a top view of the present embodiment.

The tractors 17 and 18 and the tractor covers 20 and 21 function to guide the record paper taken off of the record paper roll 36 to the platen roll 12 which is a portion of the record means 10, 12 and also guide the fan-folded form taken off of the fan-folded form stack 19 to the platen roll 12. After record paper from stack 19 or paper roll 36 passes through the tractors 17 and 18 and the tractor covers 20 and 21, they are guided to the platen roll 12 through a first common feed path. A lever 22 to detect an end of the record paper or form, that is, to detect an absence of paper, extends to the common feed path. The lever 22 is pivotally mounted on each of the tractors 17 and 18 and biased to press the paper when the paper is loaded as shown in FIG. 6. When the end of the paper arrives, the lever 22 is rotated to turn on a microswitch 23 so that the end of the paper is detected. At this time, the recording is automatically stopped. In FIGS. 7 and 8, numeral 24 denotes a pulse motor, a rotation of which is transmitted to a drive shaft 28 of the tractors 17 and 18 through gears 25, 26 and 27 so that the fan-folded form is fed. As best shown by reference to FIG. 7, the gear 26 includes a shaft with an integral coaxial gear 26*a* that engages with gear 27. Further, the shaft of gear 26 has an integral coaxial pulley 26*b*, that carries belt 30, so as to rotate pulley 31 and, thereby, platen roll 12. Hence, with reference to FIGS. 6 and 8, tractor drive shaft 28 rotates counterclockwise and platen roll 12 rotates clockwise, as pulse motor 24 rotates counterclockwise. The rotation of the pulse motor 24 is also transmitted to the platen roll 12 through the gears 25 and 26, a belt 30 and a pulley 31. The feed amount of the platen roll 12 is selected to be a little larger than the feed amount of the tractors 17 and 18 to apply a tension to the form. Numeral 32 denotes a platen knob fixed to one end of the platen roll 12. FIG. 6 shows a printed circuit board 33 for providing a control circuit 33*a* of the recorder 100. Numeral 34 denotes a holder of the record paper roll 36 which is a U-shaped groove formed in the lower case 6. The length of the groove is equal to the width of the largest record paper roll 36 used in the recorder 100.

A multi-function cover 35 is releasably or removably attached to the upper case 7 by projections 35*a* at the opposite ends. The cover 35 continuously covers the platten roll 12, the tractors 17 and 18 and the roll holder 34 and it has a generally trianglar shape in a side elevation to conform with the outer shape of the record paper roll 36. The multi-function cover 35 is removable from the upper case 7. In addition to the cover 35 which covers the roll holder 34, formed in the cover 35 is a slit 35*b* which guides a noncontinuous record sheet or record paper 37 to the platen roll 12 from the top of the recorder 100. A second feed path along which the record sheet 37 is fed from the slit 35*b* to the platen roll 12 is different from the first feed path, but after the record sheet 37 has been wrapped around the platen roll 12, it is fed along the same feed path as the elongated record form. Numeral 38 denotes a two-position switch fixed to a chassis 100*a* of the recorder 100. When it is at a first position, it passes the detection signal from the microswitch 23 and when it is a second position it cancels the detection signal from the microswitch 23. Switch 38 is actuated in a conventional manner, and is also conventionally connected to interrupt a disable signal from microswitch 23 that is passed to the printer head 10. One conventional switching actuation and connection of this type is shown by Japanese Laid-Open Publication No. 55-44808. Thus, an inadvertent detection of absence of paper can be prevented when only the record sheets 37 are used in the recorder 100.

An opening 39 is formed at the rear of the recorder 100 between the multi-function cover 35 and the lower case 6. An edge 6A of the lower case 6 adjacent to the opening 39 is curved as shown in FIG. 6 so that the fan-folded form taken off of the fan-folded form stack 19 is smoothly guided to the tractors 17 and 18. The fan-folded form taken through the opening 39 is guided to the tractors 17 and 18 through the holding space for the record paper roll 36 provided by the cover 35 and wrapped around the platen roll 12.

The operation of the present embodiment is now explained. The operation when the record sheets 37 are used is first explained. The switch 38 is slid to the second position. Then, the record sheet 37 is inserted into the slit 35*b*. The actuation lever 16 is actuated to move the paper pressing roller 14 to a position shown by a chain line (FIG. 6) which is apart from the platen roll 12. The platen knob 32 is rotated so that the record sheet 37 is fed by the frictional force provided by a pressing force acting between the platen roll 12 and the pinch roller 15. When the leading edge of the sheet 37 reaches the space between the paper pressing roller 14 and the platen roll 12, the paper pressing roller 14 is moved toward the platen roll 12 to press the sheet 37. Then, the record operation is started by a command from a control circuit, 33*a*.

The operation when the record paper roll 36 is used is now explained. The cover 35 is rotated around the projection 35*a* on the opposite sides of the cover 35 to open the cover 35. Then, the tractors 17 and 18 are moved in the direction of the paper width to set the paper width. The tractor covers 20 and 21 are opened and the opposite edges of the record paper are held by the tractors 17 and 18 and the tractor covers 20 and 21. The record paper is set such that it does not contact the pins 17*a* and 18*a*. Then, the leading edge of the record paper is inserted into the space between the platen roll 12 and the pinch roller 15. Then, the cover 35 is closed in the same manner as described above and the recording operation is started.

When the fan-folded form stack 19 is used, the cover 35 is opened and the tractors 17 and 18 are set to the form width. The left and right tractor covers 20 and 21 are opened and the holes on the opposite edges of the fan-folded form from stack 19 are fitted to the pins 17*a* and 18*a*, and the left and right tractor covers 20 and 21 are closed. The cover 35 is then closed in the same manner as described above and the recording operation is started.

As described hereinabove, according to the present invention, a variety of record papers can be selectively used and the loading of the papers and the removal of jammed paper can be readily accomplished. Since the top surface of the recorder 100 is entirely covered by the cover 35, the entry of dust or foreign material into the recorder 100 is effectively prevented and the emission of noise from the case 67 is suppressed.

What I claim is:

1. A recording apparatus comprising:

a body including a case;

first feed means for feeding a recording sheet by frictional force in a sheet feed direction so as to pass a recording position;

a guide portion for guiding a continuous record sheet supplied from a record paper source;

second feed means disposed closely proximate to and upstream from said first feed means with respect to the sheet feed direction for accepting the record sheet from said guide portion and feeding the record sheet in the sheet feed direction so as to pass the recording position and through said first feed means, said second feed means including at least one pin disposed for cooperating with at least one hole in the record sheet; and cover means rotatably attached to said case for covering said guide portion and said second feed means, said cover means comprising a free end including a guide for guiding a non-continuous record sheet from outside of the recording apparatus so as to pass said recording position and through said first feed means, said cover means further comprising an engagement portion on the opposite end of said cover means from said guide for rotatably attaching said cover means to said case.

2. A recording apparatus according to claim 1, wherein said cover means is releasably attached to said case.

3. A recording apparatus according to claim 1, further comprising driving means for generating a driving force and transmission means for transmitting the driving force from said driving means to said first feed means and said second feed means to actuate said first feed means and said second feed means, respectively.

4. A recording apparatus according to claim 3, further comprising means for manually actuating said first feed means.

5. A recording apparatus according to claim 4, wherein said first feed means includes a platen roller and said actuating means is a knob member for manually rotating said platen roller.

6. A recording apparatus according to claim 3, wherein said driving means is a motor and said transmission means includes a gear for transmitting a rotation force of the motor to said first and second feed means.

7. A recording apparatus according to claim 1, wherein said cover means has an elongated shape to cover said first feed means.

* * * * *

UNITED STATES PATENT AND TRADEMARK OFFICE

CERTIFICATE OF CORRECTION

PATENT NO. : 4,826,335

DATED : May 2, 1989

INVENTOR(S) : Kimura

It is certified that error appears in the above-identified patent and that said Letters Patent is hereby corrected as shown below:

Title page:

AT [63]
Change " Feb. 24, 1987," to --Feb. 24, 1986,--.

COLUMN 1
Line 34, change "which" to --in which--.
Line 51, delete "up".
Line 52, change "to a printed" to --printed up to a--.

COLUMN 2
Line 13, change "mount 8a" to --mount 8a,--.
Line 35, change "two way arrow" to --two-way arrow--.
Line 53, change "assures" to --assure--.

COLUMN 3
Line 38, change "platten" to --platen--.
Line 54, change "is a" to --is at a--.

UNITED STATES PATENT AND TRADEMARK OFFICE

CERTIFICATE OF CORRECTION

PATENT NO. : 4,826,335

DATED : May 2, 1989

INVENTOR(S) : Kimura

It is certified that error appears in the above-identified patent and that said Letters Patent is hereby corrected as shown below:

COLUMN 4

Line 21, change "a control circuit, 33a." to --the control circuit 33a.--.

Signed and Sealed this

Nineteenth Day of December, 1989

*Attest:*

JEFFREY M. SAMUELS

*Attesting Officer*

*Acting Commissioner of Patents and Trademarks*